US007856992B2

(12) United States Patent
Zhou et al.

(10) Patent No.: US 7,856,992 B2
(45) Date of Patent: Dec. 28, 2010

(54) TOBACCO CATALYST AND METHODS FOR REDUCING THE AMOUNT OF UNDESIRABLE SMALL MOLECULES IN TOBACCO SMOKE

(75) Inventors: Bing Zhou, Cranbury, NJ (US); Sukesh Parasher, Lawrenceville, NJ (US); Michael Rueter, Plymouth Meeting, PA (US); Zhihua Wu, Plainsboro, NJ (US)

(73) Assignee: Headwaters Technology Innovation, LLC, Lawrenceville, NJ (US)

( * ) Notice: Subject to any disclaimer, the term of this patent is extended or adjusted under 35 U.S.C. 154(b) by 1479 days.

(21) Appl. No.: 11/054,196

(22) Filed: Feb. 9, 2005

(65) Prior Publication Data

US 2006/0174902 A1 Aug. 10, 2006

(51) Int. Cl.
*A24B 15/00* (2006.01)

(52) U.S. Cl. ..... 131/352; 131/334

(58) Field of Classification Search ..... None
See application file for complete search history.

(56) References Cited

U.S. PATENT DOCUMENTS

| | | | |
|---|---|---|---|
| 3,332,755 | A | 7/1967 | Kukin |
| 3,656,901 | A | 4/1972 | Kummerle |
| 3,839,225 | A | 10/1974 | Acres |
| 3,864,451 | A | 2/1975 | Lee et al. |
| 3,885,020 | A | 5/1975 | Whelan |
| 3,900,428 | A | 8/1975 | Mai et al. |
| 3,925,001 | A | 12/1975 | Salooja |
| 3,926,854 | A | 12/1975 | Whelan et al. |
| 3,947,380 | A | 3/1976 | Whelan et al. |
| 3,976,599 | A | 8/1976 | Whelan et al. |
| 3,987,146 | A | 10/1976 | Clay et al. |
| 4,082,837 | A | 4/1978 | Whelan |
| 4,088,606 | A | 5/1978 | Fedor et al. |
| 4,108,761 | A | 8/1978 | Sze et al. |
| 4,158,044 | A | 6/1979 | Takabatake et al. |
| 4,273,749 | A | 6/1981 | Kimura etal. |
| 4,289,737 | A | 9/1981 | Acres et al. |
| 4,331,638 | A | 5/1982 | Michelfelder |
| 4,366,085 | A | 12/1982 | Ikegami et al. |

(Continued)

FOREIGN PATENT DOCUMENTS

| | | |
|---|---|---|
| DE | 3317504 | 11/1984 |

(Continued)

OTHER PUBLICATIONS

Sun, et al., Monodisperse MFe2O4 (M= Fe, Co, Mn) Nanoparticles, J. Am. Chem. Soc. 2004, 126, 273-279.*

(Continued)

*Primary Examiner*—Philip C Tucker
*Assistant Examiner*—Michael J Felton
(74) *Attorney, Agent, or Firm*—Workman Nydegger

(57) ABSTRACT

Tobacco products and articles are disclosed that include a nanoparticle catalyst. The nanoparticles are capable of degrading undesirable small molecules in tobacco smoke. The nanoparticle catalyst includes a dispersing agent that inhibits the deactivation of the nanoparticle catalyst. One embodiment disclosed has a dispersing agent that anchors the nanoparticles to a support material thereby preventing agglomeration of the nanoparticles. The dispersed nanoparticles exhibit higher activity and reduce the required loading in the tobacco material.

26 Claims, 3 Drawing Sheets

U.S. PATENT DOCUMENTS

| | | | |
|---|---|---|---|
| 4,374,105 | A | 2/1983 | Anderson et al. |
| 4,375,949 | A | 3/1983 | Salooja |
| 4,397,321 | A | 8/1983 | Stuetz |
| 4,433,065 | A | 2/1984 | van der Burgt et al. |
| 4,513,098 | A | 4/1985 | Tsao |
| 4,515,092 | A | 5/1985 | Walsh et al. |
| 4,581,344 | A | 4/1986 | Ledoux et al. |
| 4,591,430 | A | 5/1986 | Hudson |
| 4,804,388 | A | 2/1989 | Kukin |
| 4,824,360 | A | 4/1989 | Janka et al. |
| 4,836,117 | A | 6/1989 | Teller et al. |
| 4,842,617 | A | 6/1989 | Kukin |
| 4,843,980 | A | 7/1989 | Markham et al. |
| 4,880,378 | A | 11/1989 | Hums |
| 4,966,882 | A | 10/1990 | Kakto et al. |
| 5,024,905 | A | 6/1991 | Itoh et al. |
| 5,055,029 | A | 10/1991 | Avidan et al. |
| 5,087,600 | A | 2/1992 | Kato et al. |
| 5,110,452 | A | 5/1992 | Meyer et al. |
| 5,118,282 | A | 6/1992 | Reynolds et al. |
| 5,132,099 | A | 7/1992 | Hiramatsu et al. |
| 5,176,088 | A | 1/1993 | Amrhein et al. |
| 5,211,684 | A | 5/1993 | Shannon et al. |
| 5,338,531 | A | 8/1994 | Chuang et al. |
| 5,378,443 | A | 1/1995 | Engstrom et al. |
| 5,384,301 | A | 1/1995 | Flytzani-Stephanolpoulos et al. |
| 5,419,286 | A | 5/1995 | Edison et al. |
| 5,516,741 | A | 5/1996 | Gascoyne et al. |
| 5,580,839 | A | 12/1996 | Huffman et al. |
| 5,597,771 | A | 1/1997 | Hu et al. |
| 5,612,010 | A | 3/1997 | Pandey et al. |
| 5,662,051 | A | 9/1997 | Morin |
| 5,671,758 | A | 9/1997 | Rongved |
| 5,705,053 | A | 1/1998 | Buchanan |
| 5,740,667 | A | 4/1998 | Bhattacharyya et al. |
| 5,756,059 | A | 5/1998 | Zamansky et al. |
| 5,823,758 | A | 10/1998 | Lack |
| 5,846,898 | A | 12/1998 | Chuang et al. |
| 5,866,501 | A | 2/1999 | Prahhan et al. |
| 5,871,638 | A | 2/1999 | Pradhan et al. |
| 5,899,678 | A | 5/1999 | Thomson et al. |
| 5,925,588 | A | 7/1999 | Chuang et al. |
| 5,936,134 | A | 8/1999 | Mastral Lamarca et al. |
| 5,967,061 | A | 10/1999 | Ashworth |
| 6,007,699 | A | 12/1999 | Cole |
| 6,054,507 | A | 4/2000 | Funaki et al. |
| 6,090,858 | A | 7/2000 | El-Sayed |
| 6,127,307 | A | 10/2000 | Muller et al. |
| 6,159,267 | A | 12/2000 | Hampden-Smith |
| 6,168,775 | B1 | 1/2001 | Zhou et al. |
| 6,194,338 | B1 | 2/2001 | Andolfatto et al. |
| 6,206,685 | B1 | 3/2001 | Zamansky et al. |
| 6,280,695 | B1 | 8/2001 | Lissianski et al. |
| 6,401,634 | B1 | 6/2002 | Anderson |
| 6,471,506 | B1 | 10/2002 | Zamansky et al. |
| 6,494,153 | B1 | 12/2002 | Lyon |
| 6,528,683 | B1 | 3/2003 | Heidemann et al. |
| 6,534,661 | B1 | 3/2003 | Zhou et al. |
| 6,551,960 | B1 | 4/2003 | Laine et al. |
| 6,572,761 | B2 | 6/2003 | Lyon |
| 6,612,249 | B2 | 9/2003 | Sanders |
| 6,676,919 | B1 | 1/2004 | Fischer et al. |
| 6,706,902 | B2 | 3/2004 | Sturmann et al. |
| 6,716,525 | B1 | 4/2004 | Yadav et al. |
| 6,740,133 | B2 | 5/2004 | Hundley, Jr. |
| 6,740,615 | B2 | 5/2004 | Zhou |
| 6,746,597 | B2 | 6/2004 | Zhou et al. |
| 6,776,606 | B2 | 8/2004 | Haskew ..... 431/2 |
| 6,782,892 | B2 | 8/2004 | Li et al. |
| 6,923,945 | B2 | 8/2005 | Chen |
| 2003/0000538 | A1 * | 1/2003 | Bereman ..... 131/352 |
| 2003/0005622 | A1 | 1/2003 | Hundley |
| 2004/0007241 | A1 | 1/2004 | Li et al. |
| 2004/0013601 | A1 | 1/2004 | Butz et al. |
| 2004/0037770 | A1 | 2/2004 | Fischer et al. |
| 2004/0168365 | A1 | 9/2004 | Hundley |
| 2004/0241502 | A1 | 12/2004 | Chung et al. |
| 2005/0016057 | A1 | 1/2005 | Factor et al. |
| 2005/0039382 | A1 | 2/2005 | Blanchard et al. |
| 2005/0060929 | A1 | 3/2005 | Caprotti et al. |
| 2005/0108925 | A1 | 5/2005 | Jurng et al. |
| 2005/0109356 | A1 | 5/2005 | Reddy et al. |
| 2005/0257724 | A1 | 11/2005 | Guinther et al. |
| 2006/0117651 | A1 | 6/2006 | Hundley |

FOREIGN PATENT DOCUMENTS

| | | |
|---|---|---|
| JP | 4-136601 | 6/1905 |
| JP | 4-136602 | 6/1905 |
| WO | 98/45037 | 10/1998 |
| WO | 02/058825 | 8/2002 |
| WO | WO 02/083550 | 10/2002 |
| WO | 03/053560 | 7/2003 |
| WO | 03/086115 | 10/2003 |
| WO | 2004/110184 | 12/2004 |
| WO | 2005/039327 | 5/2005 |
| WO | 2005/039328 | 5/2005 |

OTHER PUBLICATIONS

Ahmadi, et al., "Shape-Controlled Synthesis of Colloidal Platinum Nanoparticles" *Science*, vol. 272, pp. 1924-1926 (Jun. 28, 1996).

Li, et al., "Carbon Nanotubes as Support for Cathode Catalyst of a Direct Methanol Fuel Cell", *Letters to the Editor/Carbon 40*, Dalian University of Technology, pp. 787-803 (Jan. 18, 2002).

Li, et al., "Preparation and Characterization of Multiwalled Carbon Nanotube-Supported Platinum for Cathode Catalysts of Direct Methanol Fuel Cells", *J. Phys. Chem*, B, vol. 107, pp. 6292-6299 (Jun. 6, 2003).

Lordi, et al., "Method for Supporting Platinum on Single-Walled Carbon Nanotubes for a Selective hydrogenation Catalyst", *Chem. Mater.*, vol. 13, pp. 733-737 (Feb. 10, 2001).

Zhou, et al., "Novel Synthesis of Highly Active Pt/C Cathode Electrocatalyst for Direct Methanol Fuel Cell" Chem. Commun. 2003, pp. 394-395.

Zhou, et al. "Preparation and Characterization of Anode Catalysts PtRu/C for Direct Methanol Fuel Cells" Chemical Journal of Chinese Universities, vol. 24, 2003, pp. 885-862.

Asami, Kenji et al., "Highly Active Iron Catalysts from Ferrie Chloride for the Steam Gasification of Brown Coal", American Chemical Society, Ind. Eng. Chem. Res. 1993, 32 pgs. 1631-1636.

Mori, Hiroshi et al., "Role of Iron Catalyst in Fate of Fuel Nitrogen during Coal Pyrolysis", Institute for Chemical Reaction Science, Tohoku University, Sendai, Japan, pp. 1022-1027 (Mar. 6, 1996).

Ohtsuka, Yasuo et al., "Char-Nitrogen Functionality and Interactions between the Nitrogen and Iron in the Iron-Catalyzed Conversion Process of Coal Nitrogen to N2" Research Center for Organic Resources and Materials Chemistry, Institute for Chemical Reactions Science, Tohoku University, Sendai, Japan, pp. 1356-1362, (May 6, 1998).

Ohtsuka, Yasuo et al., "Nitrogen Removal During Atmospheric-Pressure Pyrolysis of Brown Coal with Iron Fuel", 1994, vol. 73, No. 7, pp. 1093-1097.

Ohtsuka, Yasuo et al., "Selective Conversion of Coal Nitrogen to N2 with Iron", Research Center for Cabonaceous Resources, Institute for Chemical Reactions Science, Tohoku, Japan, pp. 1095-1096 (Aug. 3, 1993).

Tsubouchi, Naoto et al., "Nitrogen Release During High Temperature Pyrolysis of Coals and Catalytic Role of Calcium in N2 Formation", Research Center for Sustainable Material Engineering, Institute of Multidisciplinary Research for Advanced Material, Tohoku, Japan, pp. 2335-2342 (Mar. 20, 2002).

Wang, H.P. et al., "Spectroscopic Studies of Coal Maceral Depolymerization Effected by an Iron-Based Catalystl", U.S. Department of Energy 1992, http://www-acerc.byu.edu/Abstracts/19. (1992).
Wu, Zhiheng et al., "Catalytic Nitrogen Release During a Fixed-Bed Pyrolysis of Model Coals Containing Pyrrolic of Pyridinic Nitrogen", Surface Chemistry Department, National Institute of Material and Chemical Research, Tsukuba, Japan, Energy Resource Department, National Institute and Environment, Tsukuba, Japan, pp. 251-254 (Sep. 16, 1999).
Wu, Zhiheng et al., "Formation of Nitrogen-Containing Compounds during Slow Pyrolysis and Oxidation of Petroleum Coke", Institute for Chemical Reaction Science, Tohoku University, Sendai, Japan, (Jan. 17, 1997).
Wu, Zhiheng et al., "Key Factors for Formation of N2 from Low-Rank Coals during Fixed Pyrolysis: Pryolysis Conditions and Inherent Minerals", Institute for Chemical Reaction Science, Tohoku University, Sendai, Japan, pp. 902-908 (Feb. 4, 1997).
Wu, Zhiheng et al., "Nitrogen Distribution in a Fixed Bed Pyrolysis of Coals with Different Ranks: Formation and Source of N2", Institute for Chemical Reaction Science, Tohoku University, Sendai, Japan, pp. 447-482 (Aug. 5, 1996).
Wu, Zhiheng et al., "Remarkable Formation of $N_2$ from a Chinese Lignite during Coal Pyrolysis, Research Center for Carbonaceous Resources, Institute for Chemical Reaction Science", Tohoku, Japan, pp. 1280-1281 (Aug. 20, 1996).
Fuel Tech—Fuel Chem® Solutions to Boiler Slagging and Fouling Problems, retrieved from the internet: http://www.fuel-tech.com/fuelchem.htm.
ABR Mayer et al., Colloidal Platinum-Polyacid Nanocatalyst Systems, 259 Die Angewandte Makromolekulare Chemi 45-53 (1998).
Office Action dated Oct. 29, 2008 cited in U.S. Appl. No. 11/104,324.
Office Action dated Feb. 17, 2009 cited in U.S. Appl. No. 11/104,324.
Office Action dated Jun. 9, 2009 cited in U.S. Appl. No. 11/104,324.
Office Action dated Dec. 24, 2009 cited in U.S. Appl. No. 11/104,324.
Notice of Allowance dated Jun. 10, 2010 cited in U.S. Appl. No. 11/104,324.

* cited by examiner

TOBACCO CATALYST AND METHODS FOR REDUCING THE AMOUNT OF UNDESIRABLE SMALL MOLECULES IN TOBACCO SMOKE

BACKGROUND OF THE INVENTION

1. The Field of the Invention

The present invention relates to highly dispersed nanoparticle catalysts. In particular, embodiments of the present invention relate to dispersed nanoparticle catalysts that are combined with tobacco to reduce unwanted combustion and pyrolysis products such as carbon monoxide.

2. Related Technology

Burning tobacco can generate potentially undesirable small molecules such as carbon monoxide and nitric oxide. During smoking, these molecules are formed in three ways: (1) thermal decomposition (i.e., pyrolysis), (2) incomplete combustion, and (3) reduction of carbon dioxide with carbonized tobacco.

During smoking a typical cigarette has three distinct regions as it is consumed: the combustion zone, the pyrolysis/distillation zone, and the condensation/filtration zone. The "combustion zone" is the burning zone of the smoking article. Temperatures in the combustion zone range from about 700° C. to about 950° C. The rate of heating can go as high as 500° C./second depending on the rate of inhalation or puffing. The concentration of oxygen in the combustion zone is low since oxygen is being consumed to combust the tobacco to produce carbon dioxide, water vapor, and various organics. The low oxygen levels can increase the formation of undesirable small molecules such as carbon monoxide and/or nitric oxide.

The combustion reaction is highly exothermic and the heat generated is carried by gas to the pyrolysis/distillation zone. The low oxygen concentration coupled with the high temperature can lead to the reduction of carbon dioxide to carbon monoxide by carbonized tobacco in the "pyrolysis zone", which is the region behind the combustion zone. Temperatures in this region can range from about 200° C. to about 600° C. The pyrolysis zone is where most of the carbon monoxide is produced. The major reaction in this region is the pyrolysis (i.e., thermal degradation) of the tobacco that produces carbon monoxide, carbon dioxide, smoke components, and charcoal from the heat generated in the combustion zone.

The third region of a typical cigarette is the condensation/filtration zone. Temperatures in this zone range from ambient to about 150° C.

Recently, catalysts have been developed to remove undesired chemicals in tobacco smoke. The catalyst is applied to the tobacco, cigarette filter, or other component of the smoking apparatus to oxidize carbon monoxide and light organic compounds to form harmless compounds such as carbon dioxide. Various catalysts have been developed in an attempt to eliminate undesired combustion and pyrolysis products from tobacco smoke. Existing catalysts have used a wide variety of catalyst components. For example, existing tobacco catalysts use a ceramic material such as alumina or zirconia which is combined with a platinum group metal. Other existing catalyst are made from metal oxides, such as vanadium pentoxide, mixtures of iron and manganese, or iron by itself.

Existing catalysts, however, are inefficient, cost prohibitive and/or nonselective in destroying undesirable combustion and pyrolysis products. One particularly difficult problem is the destruction of the catalyst particles by the heat generated in combustion and/or pyrolysis. While the high temperatures can be useful or even necessary for catalyst function, the extreme temperatures can cause deactivation of the catalyst, such as by sintering or agglomeration. Agglomeration of catalyst particles dramatically reduces the catalytic surface area, thus reducing the efficiency of the catalyst. Because of the reduced efficiency of existing catalysts, the tobacco must have higher loadings of catalyst to achieve the desired destruction of carbon monoxide and light organics. In the case of existing iron catalysts, the required catalyst loading is too high to be practical.

Therefore, what is needed is a cost effective catalyst that can be combined with tobacco in reasonable amounts to eliminate undesired combustion and pyrolysis products.

BRIEF SUMMARY OF THE INVENTION

The present invention provides compositions and methods for overcoming the limitations of the aforementioned prior art by providing very fine catalyst particles that are stabilized. The catalyst nanoparticles reduce the amount of undesirable small molecules generated during the chemical degradation of the tobacco material that occurs when the tobacco is consumed in a burning cigarette, for example.

In an exemplary embodiment, the catalysts compositions of the present invention include a dispersing agent. The dispersing agent is an organic compound with functional groups that can chemically interact with the atoms of the catalyst particles. These chemical interactions can assist in forming nanoparticles and/or give the catalyst particles desired properties. In an exemplary embodiment, the dispersing agent assists in forming a suspension of nanoparticles.

Organic compounds with certain functional groups are particularly useful as dispersing agents. In an exemplary embodiment, the dispersing agent includes one or more of a hydroxyl, carboxyl, thiol, sulfonic acid, sulfonyl halide, carbonyl, amine, amide, amino acid, or acyl halide. Examples of dispersing agents that include such functional groups include glycolic, oxalic, malic, and citric acids and polymers such as pectins, amino acids, celluloses, polyacrylic acid, and similar organic molecules.

In an exemplary embodiment, the dispersing agent forms nanosized catalyst particles. In a preferred embodiment, the size of the nanoparticle catalysts is less than about 100 nm, more preferably less than about 10 nm even more preferably less than about 6 nm and most preferably less than 4 nm.

Another feature of exemplary embodiments of the present invention is that the dispersing agent binds to the catalyst atoms and prevents or inhibits agglomeration of the catalyst particles during combustion or pyrolysis.

The dispersing agents and methods of making the tobacco catalysts of the present invention can be used with almost any nanoparticles suitable for degrading unwanted combustion and pyrolysis products found in tobacco smoke. Examples of suitable catalyst components include copper oxide, manganese, manganese oxide, platinum, palladium, iron, iron oxide, vanadium oxide, aluminum oxide, silica, titania, yttria, and combinations of these. In one currently preferred embodiment, the catalyst particles are made from iron and/or iron oxide. While other catalyst atoms are as effective or even more effective at degrading carbon monoxide, iron-based catalysts are advantageous because they are very inexpensive.

Unlike iron-based catalysts in the prior art, the iron-based catalysts according to the present invention are sufficiently small, dispersed and stabilized that they can effectively and selectively reduce unwanted products in tobacco smoke, such as carbon monoxide and nitric oxide.

Another significant advantage of the catalysts of the present invention is their stability under extreme temperatures. The dispersing agent stabilizes the catalyst particles and prevents deactivation of the catalyst nanoparticles. In one embodiment, the catalyst particles are anchored to a substrate thereby preventing sintering or agglomeration of catalyst after deposition or during use. Preventing agglomeration ensures the benefits of small particle size are obtained at higher temperatures and/or for longer periods of time in a burning cigarette. These benefits are believed to allow the nanoparticles to operate in the hotter portions of a cigarette. Furthermore, catalysts that require higher operating temperatures can be used.

The catalysts and methods according to the present invention increase efficiencies thereby allowing lower loading of catalyst in the tobacco material. The dispersion and stability of the catalysts of the present invention increases the activity of the catalysts particles such that lower amounts of the catalyst can be loaded while still providing the necessary catalytic activity. This increase in efficiency reduces the cost of the catalyst and/or allows for new types of catalysts to be used as tobacco catalysts.

The catalysts of the present invention may also have more selectivity for eliminating undesirable small molecules rather than the desirable large flavor bearing molecules. This selectivity may be due to the decrease in catalyst loading, the consistent small size of the nanoparticles, or the presence of the dispersing agent.

These and other features of the present invention will become more fully apparent from the following description and appended claims as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

I. Introduction and Definitions

Figure 1:
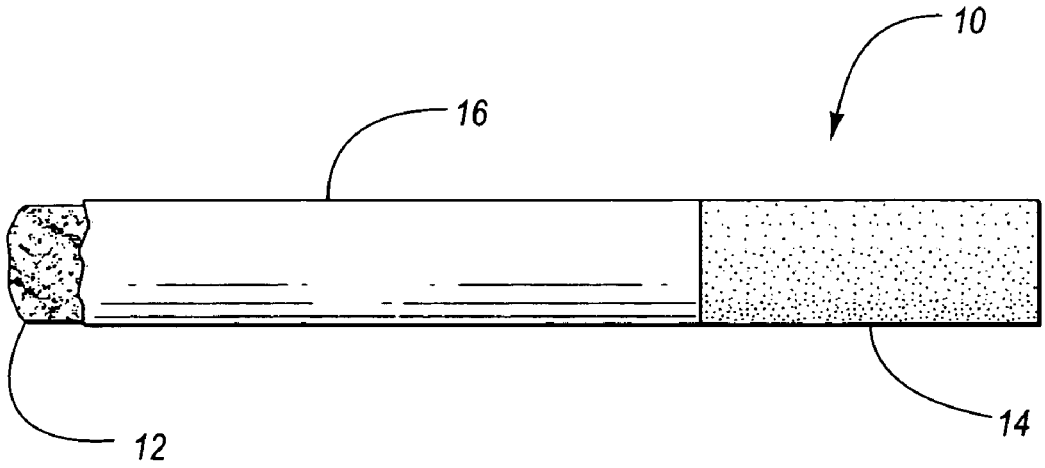
FIG. 1 illustrates a perspective view of an exemplary burning cigarette according to the present invention.

The present invention includes catalyst compositions and methods for applying the catalyst to tobacco, which results in efficient usage of catalyst material and efficient destruction of carbon monoxide and other light molecules in tobacco smoke. The present invention uses dispersed nanoparticle catalysts in tobacco materials to convert undesirable small molecules such as carbon monoxide and nitric oxide to safer substances such as carbon dioxide and nitrogen.

The present invention includes tobacco compositions, articles, and methods of making such compositions and articles using a dispersing agent. The dispersing agent binds to and/or interacts with at least a portion of the catalyst atoms such that the catalyst particles formed therefrom are dispersed and/or anchored to a substrate. The interactions between the dispersing agent and the catalyst particles stabilize the catalyst particles.

In an exemplary embodiment, the stabilized catalyst particles are mixed with the tobacco material and formed into a cigarette. Alternatively the catalyst particles can be placed in or on a cigarette filter.

For purposes of this invention, the term "tobacco" includes both natural tobacco and tobacco substitutes which are combustible and designed to mimic natural tobacco in one or more aspects such as chemical stimulation and/or burning properties.

"Tobacco smoke" means the mixture of gases and particulates given off as a tobacco composition undergoes combustion, pyrolysis, and/or heating.

For purposes of this invention the term "catalyst" does not exclude atoms, molecules, and/or particles that are consumed in a reaction, such as the degradation of unwanted molecules in tobacco smoke. For example, in some embodiments, the catalyst of the present invention can be consumed by reduction or oxidation.

II. Nanoparticle Catalysts

A. Catalyst Complexes

Catalyst complexes include one or more different types of catalyst atoms complexed with one or more different types of dispersing agents. When so complexed, the catalyst atoms are arranged in such a manner that the catalyst atoms either (i) form dispersed nanoparticles in solution or (ii) that upon contact with a substrate, the catalyst complexes form dispersed nanoparticles. In either case, the dispersing agent can form a catalyst complex to produce nanoparticles that are dispersed, stable, uniform, and/or desirably sized.

1. Catalyst Atoms

Any element or group of elements or molecules that can catalytically degrade or oxidize or reduce unwanted chemicals in tobacco smoke, or otherwise improve the burn properties of tobacco can be used to form catalysts according to the present invention. These include elements or groups of elements that exhibit primary catalytic activity, as well as promoters and modifiers. As the primary active component, metals are preferred. Exemplary metals can include base transition metals, noble metals, and rare earth metals. Nanoparticles may also comprise non-metal atoms, alkali metals and alkaline earth metals, typically as modifiers or promoters.

Examples of base transition metals that may exhibit activity include, but are not limited to, chromium, manganese, iron, cobalt, nickel, copper, zirconium, tin, zinc, tungsten, titanium, molybdenum, vanadium, and the like. These may be used alone, in various combinations with each other, or in combinations with other elements, such as noble metals, alkali metals, alkaline earth metals, rare earth metals, or non-metals.

Molecules such as ceramics and metal oxides can also be used in the nanoparticles of the present invention. Examples include, iron oxide, vanadium oxide, aluminum oxide, silica, titania, yttria, and the like.

Examples of noble metals, also referred to as platinum-group metals, which exhibit activity, include platinum, palladium, iridium, gold, osmium, ruthenium, rhodium, rhenium, and the like. Because noble metals are typically very expensive, these metals are generally used in combination with other elements, such as base transition metals, alkali metals, alkaline earth metals, rare earth metals, or non-metals.

Examples of rare earth metals that exhibit activity include, but are not limited to, lanthanum and cerium. These may be used alone, in various combinations with each other, or in combinations with other elements, such as base transition metals, noble metals, alkali metals, alkaline earth metals, or non-metals.

Examples of non-metals include, but are not limited to, phosphorus, oxygen, sulfur and halides, such as chlorine, bromine and fluorine. These are typically included as functionalizing agents for one or more metals, such as those listed above.

When added to an appropriate solvent or carrier to form an suspension, as described below, the catalyst atoms may be in ionic form so as to more readily dissolve or disperse within the solvent or carrier. In the case of a metallic catalyst, the catalyst atoms may be in the form of a metal halide, nitrate or other appropriate salt that is readily soluble in the solvent or carrier, e.g., metal phosphates, sulfates, tungstates, acetates, citrates, or glycolates.

2. Dispersing Agents

A dispersing agent is selected to promote the formation of catalyst particles that have a desired stability, size and/or uniformity. Dispersing agents within the scope of the invention include a variety of small organic molecules, polymers and oligomers. The dispersing agent comprises individual molecules that mediate in the formation of the dispersed catalyst particles.

In general, useful dispersing agents include organic compounds that can form catalyst complexes within compositions that include the dispersing agent, catalyst atoms, an appropriate solvent or carrier, and optional promoters or support materials. The dispersing agent is able to interact and complex with catalyst atoms dissolved or dispersed within an appropriate solvent or carrier through various mechanisms, including ionic bonding, covalent bonding, Van der Waals interaction, or hydrogen bonding.

To provide the interaction between the dispersing agent and the catalyst atoms, the dispersing agent includes one or more appropriate functional groups. Preferred dispersing agents include functional groups that can be used to complex a catalyst atom. These functional groups allow the dispersing agent to have a strong binding interaction with dissolved catalyst atoms, which are preferably in the form of ions in solution.

The dispersing agent may be a natural or synthetic compound. In the case where the nanoparticle atoms are metals and the dispersing agent is an organic compound, the catalyst complex so formed is an organometallic complex.

In an exemplary embodiment, the functional groups of the dispersing agent may include one or more of a hydroxyl, carboxyl, thiol, sulfonic acid, sulfonyl halide, carbonyl, amine, amide, amino acid, acyl halide and combinations of these. Examples of suitable dispersing agents include glycolic acid, oxalic acid, malic acid, citric acids, pectins, amino acids, celluloses, and combinations these.

In an exemplary embodiment, the dispersing agent is a compound that is naturally occurring in tobacco, such as one or more of citric acid, pectins, amino acids, celluloses and the like. While it is not necessary to use molecules that are naturally occurring in tobacco, use of these molecules can be advantageous because they reduce the chances of undesirable side effects and are less likely to negatively affect the taste of the cigarette.

Other dispersing agents that can be useful in present invention include polymers and oligomers or compounds. The dispersing agent can also be an inorganic compound (e.g., silicon-based).

Suitable polymers and oligomers within the scope of the invention include, but are not limited to, polyacrylates, polyvinylbenzoates, polyvinyl sulfate, polyvinyl sulfonates including sulfonated styrene, polybisphenol carbonates, polybenzimidizoles, polypyridine, sulfonated polyethylene terephthalate. Other suitable polymers include polyvinyl alcohol, polyethylene glycol, polypropylene glycol, and the like.

In addition to the characteristics of the dispersing agent, it can also be advantageous to control the molar ratio of dispersing agent to the catalyst atoms in a catalyst suspension.

In some cases, a more useful measurement is the molar ratio between dispersing agent functional groups and catalyst atoms. For example, in the case of a divalent metal ion two molar equivalents of a monovalent functional group would be necessary to provide the theoretical stoichiometric ratio. It may be desirable to provide an excess of dispersing agent functional groups to (1) ensure that all or substantially all of the catalyst atoms are complexed, (2) bond the nanoparticles to a support, and (3) help keep the nanoparticles segregated so that they do not clump or agglomerate together. In general, it will be preferable to include a molar ratio of dispersing agent functional groups to catalyst atoms in a range of about 0.01:1 to about 40:1, more preferably in a range of about 0.1:1 to about 30:1, and most preferably in a range of about 0.5 to about 20:1.

The dispersing agents of the present invention allow for the formation of very small and uniform nanoparticles. In a preferred embodiment, the catalyst nanoparticles are less than about 100 nm, more preferably less than about 10 nm, even more preferably less than about 6 nm and most preferably less than about 4 nm. However, in some embodiments, the nanoparticles can even approach the atomic scale.

As discussed below, the nanoparticles can be supported on a support surface. It is believed that when a support material is added to a suspension of catalyst particles the dispersing agent acts to uniformly disperse the complexed catalyst atoms and/or suspended nanoparticles onto the support material. This results in a more active nanoparticle since uniformly dispersing the nanoparticles allows more active sites to be exposed per unit of catalyst material.

Finally, depending on the desired stability of the nanoparticles the dispersing agent can be selected such that it acts as an anchor between the nanoparticles and a support material, which is described more fully below. During and after formation of the nanoparticles, the dispersing agent can act as an anchoring agent to secure the nanoparticle to a substrate. Preferably, the substrate has a plurality of hydroxyl or other functional groups on the surface thereof which are able to chemically bond to one or more functional groups of the dispersing agent, such as by a condensation reaction. One or more additional functional groups of the dispersing agent are also bound to one or more atoms within the nanoparticle, thereby anchoring the nanoparticle to the substrate. In one embodiment, where the tobacco is used as the support material, the OH and COOH groups on the dispersing agent bind to the same functional groups and/or molecules existing in tobacco (e.g. oxalic acid, malic acid, citric acid, pectins, sugars, amino acids, and fibers such as cellulose).

While the dispersing agent has the ability to inhibit agglomeration without anchoring, chemically bonding the nanoparticle to the substrate surface through the dispersing agent is an additional and particularly effective mechanism for preventing agglomeration.

As described more fully below, the nanoparticles are combined with a tobacco material or a tobacco article. During combustion and pyrolysis of tobacco, the dispersing agent inhibits deactivation of the nanoparticles. This ability to inhibit deactivation can increase the temperature at which the catalysts can perform and/or increase the useful life of the catalyst in extreme conditions.

C. Solvents and Carriers

A solvent or carrier may be used as a vehicle for the catalyst atoms (typically in the form of an ionic salt) and/or the dispersing agent. The solvent used to make inventive precursor compositions may be an organic solvent, water or a combination thereof. Preferred solvents are liquids with sufficient polarity to dissolve the metal salts which are preferred means of introducing the catalytic components to the precursor solution. These preferred solvents include water, methanol, ethanol, normal and isopropanol, acetonitrile, acetone, tetrahydrofuran, ethylene glycol, dimethylformamide, dimethylsulfoxide, methylene chloride, and the like, including mixtures thereof.

D. Supports and Support Materials

The nanoparticles can be isolated on a support surface. In an exemplary embodiment, the nanoparticles are supported by the tobacco material itself. In this embodiment, carbon-based components of the tobacco material form the support material for the nanoparticles. The result is a tobacco/catalyst composition or complex.

In an alternative embodiment, the nanoparticles are formed on a separate solid support. The solid support material may be organic or inorganic. The support can be chemically inert in the chemical reaction environment or the solid support itself may serve a catalytic function complementary to the function of the nanoparticles of the present invention.

Any solid support material known to those skilled in the art as useful catalytic supports may be used as supports for the dispersed nanoparticles of this invention. These supports may be in a variety of physical forms. They may be either porous or non-porous. They may be 3-dimensional structures such as a powder, granule, tablet, extrudates, or other 3-dimensional structure. Supports may also be in the form of 2-dimensional structures such as films, membranes, coatings, or other mainly 2-dimensional structures. In one embodiment, the solid support is the filter attached to, and forming part of, the cigarette.

A variety of other material components, alone or in combination, can comprise the support. One important class of support materials which is preferred for some applications is porous inorganic materials. These include, but are not limited to, alumina, silica, titania, kieselguhr, diatomaceous earth, bentonite, clay, zirconia, magnesia, as well as the oxides of various other metals, alone or in combination. They also include the class of porous solids collectively known as zeolites, natural or synthetic, which have ordered porous structures. Other useful inorganic materials include minerals such as calcium carbonate.

Another useful class of supports preferred for some applications include carbon-based materials, such as carbon black, activated carbon, graphite, fluoridated carbon, and the like. Other useful classes of support materials include organic solids, such as polymers and metals and metal alloys. Particulate supports, when impregnated with the catalyst, may be blended with tobacco to form a tobacco/catalyst composition or blend.

In the case where the nanoparticles are attached to a support, the nanoparticles can be deposited in a wide range of loadings on the support material. The loading can range from 0.01% to 75% by weight of the total weight of the supported nanoparticles, with a preferred range of 0.1% to 25%. In the case where porous solids are used as the support material, it is preferred that the surface area of the support be at least 20 m2/g, and more preferably more than 50 m2/g.

E. Methods of Making Nanoparticle Catalyst

The process for manufacturing nanoparticles can be broadly summarized as follows. First, one or more types of catalyst atoms and one or more types of dispersing agents are selected. Second, the catalyst atoms and dispersing agent are reacted or combined together to form a catalyst complex. The catalyst complex is generally formed by first dissolving the catalyst atoms and dispersing agent in an appropriate solvent or carrier in the form of salts and then allowing the salts to recombine as the catalyst complex so as to form a solution or colloidal suspension. In one embodiment, dispersed nanoparticles form in the suspension. In an alternative embodiment, the dispersing agent facilitates the formation of nanoparticles as the active atoms are disposed on a support surface in a third step. Fourth, if needed, a portion of the dispersing agent can be removed to expose the active atoms. At some point in this process, the dispersing agent may form a chemical bond with the support surface.

In one aspect of the invention, the "nanoparticle catalyst" may be considered to be the catalyst complex comprising the catalyst atoms and dispersing agent, exclusive of the surrounding solvent or carrier. Indeed, it is within the scope of the invention to create a catalyst complex in solution, or as a colloid or suspension, and then remove the solvent or carrier so as to yield a dried catalyst complex. The dried catalyst can be used in such a form, or can be used later by adding an appropriate solvent or carrier to reconstitute a solution or colloidal suspension containing the catalyst complex. Thus, in another aspect of the invention, an "intermediate precursor composition" according to the invention may include one or more different solvents or carriers into which the catalyst complex may be dispersed. The catalyst complex may be applied, or even bonded, to a support. Thus, the nanoparticle catalyst of the present invention can include the catalyst complex and a support, with or without a solvent or carrier.

Exemplary methods for making nanoparticle catalysts according to the invention include providing one or more types of catalyst atoms in solution (e.g., in the form of an salt), providing a dispersing agent in solution (e.g., in the form of a carboxylic acid salt), and reacting the catalyst atoms with the dispersing agent to form a suspension of complexed catalyst atoms and dispersing agent. The fine dispersion of the catalytic component within an appropriate solvent or carrier by the dispersing agent may be colloidal.

The catalyst atoms can be provided in any form so as to be soluble or dispersible in the solvent or carrier that is used to form the catalyst complex. In the case where the catalyst atoms comprise one or more metals, salts of these metals can be formed that are readily soluble in the solvent or carrier. In the case where the catalyst atoms include noble metals, it is advantageous to use noble metal chlorides and nitrates, since chlorides and nitrate of noble metals are more readily soluble than other salts. Chlorides and nitrates of other metal catalyst atoms, such as base transition metals and rare earth metals may likewise be used since chlorides and nitrates are typically more soluble than other types of salts.

These catalyst atoms can be added to the solvent or carrier singly or in combination to provide final catalyst particles that comprise mixtures of various types of catalyst atoms. For example, a bimetallic iron/platinum catalyst can be formed by first forming a precursor solution in which is dissolved an iron salt, such as iron chloride, and a platinum salt, such as chloroplatinic acid. In general, the composition of the final catalyst will be determined by the types of catalyst atoms added to the precursor solution. Therefore, control of the amounts of precursor salts added to the solution provides a convenient method to control the relative concentrations of different types of catalyst atoms in the final catalyst particles.

The dispersing agent is added to the solvent or carrier in a manner so as to facilitate association with the catalyst atoms in order to form the catalyst complex. Some dispersing agents may themselves be soluble in the solvent or carrier. In the case of dispersing agents that include carboxylic acid groups, it may be advantageous to form a metal salt of the acids (e.g., an alkali or alkaline earth metal salt). For example, polyacrylic acid can be provided as a sodium polyacrylate salt, which is both readily soluble in aqueous solvent systems and able to react with catalyst metal salts to form a catalyst metal-polyacrylate complex, which may be soluble or which may form a colloidal suspension within the solvent or carrier.

One aspect of the invention is that very small catalytic particles can be controllably formed (e.g., less than about 100 nm, preferably less than about 10 nm, more preferably less than about 5 nm). The inventors believe that the use of an excess quantity of the dispersing agent plays a factor in determining the size of the resulting catalyst particles.

In the case where the catalyst particles of the invention are to be formed on a solid support material, the catalyst complex solution is physically contacted with the solid support. Contacting the catalyst complex with the solid support is typically accomplished by means of an appropriate solvent or carrier within the catalyst complex solution in order to apply or impregnate the catalyst complex onto the support surface.

Depending on the physical form of the solid support, the process of contacting or applying the catalyst complex to the support may be accomplished by a variety of methods. For example, the support may be submerged or dipped into a solution or suspension comprising a solvent or carrier and the catalyst complex. Alternatively, the solution or suspension may be sprayed, poured, painted, or otherwise applied to the support. Thereafter, the solvent or carrier is removed, optionally in connection with a reaction step that causes the dispersing agent to become chemically bonded or adhered to the support. This yields a supported catalyst complex in which the active catalyst atoms are arranged in a desired fashion.

If needed, a portion of the catalyst atoms can be exposed by removing a portion of the dispersing agent such as by reduction (e.g., hydrogenation) or oxidation. Hydrogen is one preferred reducing agent. Instead of or in addition to using hydrogen as the reducing agent, a variety of other reducing agents may be used, including lithium aluminum hydride, sodium hydride, sodium borohydride, sodium bisulfite, sodium thiosulfate, hydroquinone, methanol, and aldehydes, and the like. The reduction process may be conducted at a temperature between 20° C. and 500° C., and preferably between 100° C. and 400° C. It should be pointed out that oxidation is more suitable when the catalyst atoms do not include noble metals, since noble metal catalysts might catalyze the oxidation of the entire dispersing agent, leaving none for anchoring. Oxidation is more suitable (e.g., at a maximum temperature of 150° C.), for example, in the case where the catalyst atoms comprise transition metals and the support is non-combustible (e.g., silica or alumina rather than carbon black, graphite or polymer membranes).

The process of removing the dispersing agent to expose the catalyst atoms may be controlled to ensure that enough of the dispersing agent remains so as to reliably maintain a dispersed catalyst under combustion or pyrolysis conditions. Removing the dispersing agent to the extent that little or none of it remains to disperse or anchor the catalyst particles might reduce the stability of the nanoparticle catalyst in some cases.

Supported active catalysts can be optionally heat-treated to further activate the catalyst. It has been found that, in some cases, subjecting the active catalyst to a heat treatment process before initially using the catalyst causes the catalyst to be more active initially. The step of heat treating the catalyst may be referred to as "calcining" because it may act to volatilize certain components within the catalyst. However, it is not carried out at temperatures high enough to char or destroy the dispersing agent. The heat treatment process may be carried in inert, oxidizing, or reducing atmospheres, but preferably in an inert atmosphere. Where the catalyst is subjected to a heat treatment process, the process is preferably carried out at a temperature in a range of about 50° C. to about 300° C., more preferably in a range of about 100° C. to about 250° C., and most preferably in a range of about 125° C. to about 200° C. The duration of the heat treatment process is preferably in a range of about 30 minutes to about 12 hours, more preferably in a range of about 1 hour to about 5 hours.

III. Tobacco Compositions and Articles

The nanoparticles of the present invention can be combined with tobacco to make tobacco compositions and articles such as cigarettes. The dispersed nanoparticles are associated with the tobacco such that upon combustion and/or pyrolysis of the tobacco, the smoke produced therefrom comes into contact with the nanoparticles. The nanoparticles degrade the undesirable small molecules before the smoke is inhaled by a user.

A. Tobacco Material

Most tobaccos can be used with the present invention. Examples of suitable tobaccos include flue-cured, Burley, Md. or Oriental tobaccos, rare or specialty tobaccos, and blends of these. The tobacco material can be provided in the form of tobacco lamina; processed tobacco materials such as volume expanded or puffed tobacco, processed tobacco stems such as cut-rolled or cut-puffed stems, reconstituted tobacco materials; or blends thereof. The invention may also be practiced with tobacco substitutes.

B. Application of Nanoparticles

The nanoparticles of the present invention are combined with the tobacco and/or tobacco article to convert undesirable small molecules such as carbon monoxide and nitric oxide. The nanoparticles of the present invention can be placed anywhere in or on a smoking article so long as smoke can come into contact with the nanoparticles during use.

In an exemplary embodiment, supported and/or unsupported nanoparticles are associated with a tobacco material by placing the nanoparticles where the nanoparticles are sufficiently close to gasses in tobacco smoke that the nanoparticles can perform their catalytic function. For example, the nanoparticles can be directly mixed with the tobacco material. Alternatively, the nanoparticles can be associated with the tobacco material by being deposited between the tobacco material and the filter of a cigarette. In another embodiment, the nanoparticles are disposed within the filter. In yet another embodiment, the catalyst nanoparticles are present in or on the tobacco paper used to make a cigarette as described below. Combinations of any of these methods of associating nanoparticles with the tobacco material are also possible.

Because the catalysts of the present invention are stable and highly active, the loading amount of the catalyst applied to the tobacco and/or filter can be significantly lower than catalyst loadings in the prior art. In an exemplary embodiment, the catalyst nanoparticles comprise iron and are mixed with a tobacco material with a metal loading on the tobacco material that is less than about 30% by weight, more preferably less than 15% by weight and most preferably less than about 5%.

Figure 2:
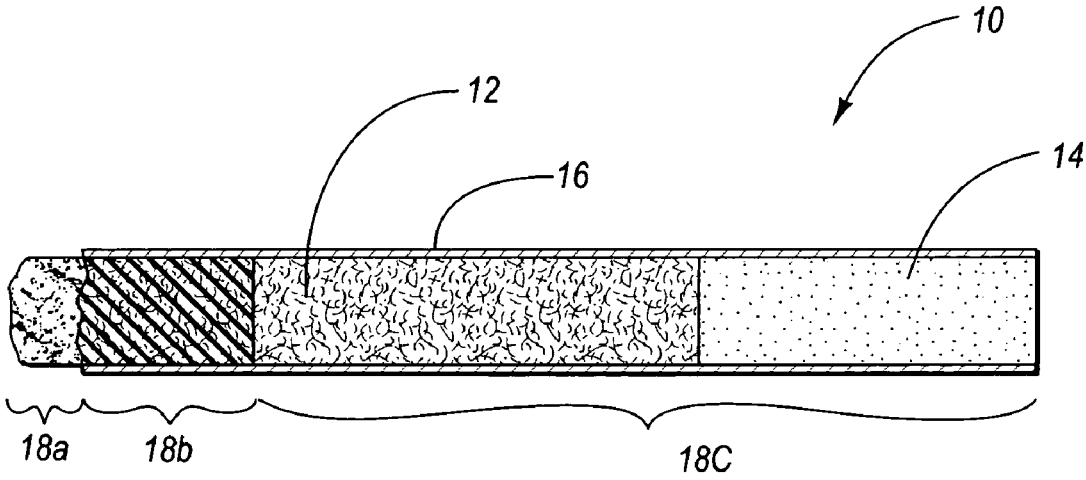
FIG. 2 illustrates a cross-sectional view of the cigarette of FIG. 1.

FIGS. 1 and 2 illustrate an exemplary burning cigarette 10 that includes a tobacco composition 12 according to the present invention. Tobacco composition 12 is tipped with a filter 14 and wrapped with paper 16. FIG. 2 shows three distinct zones of the burning cigarette. In zone 18*a*, tobacco composition 12 undergoes combustion. In zone 18*b*, tobacco composition 12 undergoes pyrolysis. Hot gases and particulates from combustion zone 18*a* passing through pyrolysis zone 18*b* heat tobacco composition 12 to cause pyrolysis and thus more gases and particulates. In zone 18*c*, condensation and filtration occur as the gases and particulates begin to cool. In the exemplary embodiment of FIGS. 1 and 2, nanoparticles comprising iron metal, iron oxide and/or other appropriate catalyst materials, together with glycolic acid and/or another dispersing agent are deposited throughout tobacco composition 12. As heat, gases, and particulates in the form of tobacco smoke are drawn through zones 18*a*-18*c*, the nanoparticles in tobacco composition 12 catalyze the destruction of undesirable small molecules, such as carbon monoxide and nitric oxide.

In one embodiment, it is also possible for the nanoparticles, at elevated temperatures, to be consumed in a redox reaction. In yet another embodiment, the nanoparticles can perform a catalytic function at one temperature and an oxidative or reductive function at another temperature.

Temperatures in zones 18*a*-18*c* can reach 900° C., 600° C., and 200° C., respectively. At temperatures between 200° C. and 900° C., traditional catalyst particles can sinter and agglomerate to form larger particles. This agglomeration can deactivate the catalyst particles by reducing the surface area available for catalysis and/or oxidation or reduction.

The catalyst nanoparticles of cigarette 10 are dispersed with a dispersing agent such as glycolic acid, which is selected to inhibit deactivation of the catalyst (e.g., iron-based) nanoparticles such as by preventing agglomeration. In one embodiment, the dispersing agent allows the nanoparticles to operate at a higher temperature. Higher operating temperatures can have significant benefits. For example, higher operating temperatures can increase catalytic activity, thus reducing the amount of required catalyst. In some cases, proper catalytic activity can only be obtained at higher temperatures. Thus higher operating temperatures can provide opportunities for using new catalysts. Alternatively, the dispersing agent increases the length of time before the nanoparticles are destroyed in combustion or pyrolysis. In this embodiment, the dispersing agent's ability to inhibit deactivation allows the nanoparticles sufficient time to degrade undesirable small molecules before being consumed.

C. Methods of Making Cigarettes

In an exemplary embodiment the tobacco is manufactured into a cigarette. In cigarette manufacture, the tobacco is normally employed in the form of cut filler, i.e. in the form of shreds or strands cut into widths ranging from about 1/10 inch to about 1/20 inch or even 1/40 inch. The lengths of the strands range from between about 0.25 inches to about 3.0 inches. The cigarettes may further comprise one or more flavorants or other additives (e.g., burn additives, combustion modifying agents, coloring agents, binders, etc.) known in the art.

Techniques for cigarette manufacture are known in the art. Any conventional or modified cigarette making technique may be used to incorporate the dispersed nanoparticles. Catalyst that is in a suspension can be sprayed or otherwise directly mixed with a tobacco material. Likewise, if the catalyst is supported on a support surface, the support material is mixed with the tobacco in proper amounts.

The resulting cigarettes can be manufactured to any known specifications using standard or modified cigarette making techniques and equipment. Typically, the cut a filler composition of the invention is optionally combined with other cigarette additives, and provided to a cigarette making machine to produce a tobacco rod, which is then wrapped in cigarette paper, and optionally tipped with filters.

Examples 1-9 below are catalyst preparations that can be used with a tobacco material according to the present invention to reduce undesirable small molecules in tobacco smoke. Examples 10-18 below illustrate the ability of the catalyst of Examples 1-9 respectively, to convert carbon monoxide to carbon dioxide.

Example 1

6% Iron on $Al_2O_3$ Support

A precursor liquid is made by mixing 0.56 g of iron powder, 1.8 g of dextrose, 1.92 g of citric acid and 100 g of water. The mixture of liquid and solid is mixed until all solid is dissolved. The precursor liquid is then added to 5.0 g of gamma-alumina with a BET surface area of 83 m2/g while stirring. The mixture of liquid and solid is then heated to 90° C. with stirring until the slurry volume is reduced to about 30 ml by evaporation. The sample is then placed in a rotating drier under a heat lamp until dry. The solid material is then further dried in an oven at 80° C. for 2 hrs.

Example 2

0.2% Iron and 22 ppm Pt on $Al_2O_3$ Support

A precursor liquid is made by mixing 0.112 g of iron powder, 1.114 g of 0.010 w % Pt solution (where the platinum solution is prepared by mixing 0.2614 g of $H_2PtCl_6$ in 1000 ml water), 0.36 g of dextrose, 0.384 g of citric acid and 100 g of water. The mixture of liquid and solid is mixed until all solid is dissolved. The precursor liquid is then added to 5.0 g of the same alumina support used in Example 1. The mixture of liquid and solid is then heated to 90° C. with stirring until the slurry volume is reduced to about 30 ml by evaporation. The sample is then placed in a rotating drier under a heat lamp until dry. The solid material is then further dried in an oven at 80° C. for 2 hrs. The dried powder is then reduced under hydrogen flow for 6 hours at 300° C.

Example 3

0.2% Iron and 22 ppm Pt on $CaCO_3$ Support

This catalyst is prepared using the same procedure as Example 2, except that the solid support is changed to calcium carbonate with surface area 6 $m^2/g$.

Example 4

6% Iron and 60 ppm Pt on $Al_2O_3$ Support

A precursor liquid is created by mixing 0.56 g of iron powder, 5.57 g of the same 0.010 w % Pt solution used in Example 2, 1.8 g of dextrose, 1.92 g of citric acid and 100 g of water. The mixture of liquid and solid is mixed until all solid is dissolved. The precursor liquid is then added to 5.0 g of the same alumina support used in Example 1. The mixture is then heated and dried by the same procedure described in Example 1.

Example 5

6% Iron and 60 ppm Pt on $CaCO_3$ Support

This catalyst is prepared using the same procedure as Example 4, except that the solid support is changed to 5.0 g of calcium carbonate, where the calcium carbonate used is the of the same type used in Example 3.

Example 6

6% Iron on $CaCO_3$ Support 0.80 g NaOH is dissolved in 40 ml of ethylene glycol, and 0.72 g of $Fe(NO_3)_3.9H_2O$ is dissolved in 10 ml ethylene glycol. The two solutions are then mixed, and 1.54 g of $CaCO_3$ (of the same type used in Example 3) is added to the resulting mixture. 50 ml of 1.0 M $NH_4NO_3$ aqueous solution was added to above solution, and the mixture of liquids is aged for 2 hours. Then the precursor is filtered and the precipitate washed 3 times with water. The precipitate is then dried at 70° C. in a vacuum oven for 3 hours, followed by further drying at 80° C. in a drying oven for 2 hours.

Example 7

6% Iron and 1 ppm Pd on $CaCO_3$ Support

A precursor liquid is created by mixing 75 ml of solution 1 (prepared by mixing 1.3339 g PdCl2 in 4.76 g HCl and then diluting to 1000 ml using water), 12 ml of solution 2 (prepared by mixing 0.2614 g of H2PtCl6 with 1000 ml of water), and 10 ml of solution 3 (prepared by diluting 15 g of 45% polyacrylate sodium salt solution (MW=1200) to a total mass of 100 g with water). The above mixture is then diluted to 500 ml with water, and stirred in a vessel fitted with a gas inlet, to which nitrogen is fed for 1 hour, followed by hydrogen for 20 minutes.

0.167 g of the above precursor liquid is then diluted to 16.67 g with water. The diluted liquid is then mixed with 0.20 g of 6% Fe/CaCO3 prepared according to Example 6. The mixture of liquid and solid is heated to 80° C. with stirring until dry. The solid is further dried at 80° C. in a drying oven for 2 hours.

Example 8

6% Iron and 10 ppm Pd on $CaCO_3$ Support 1.67 g of the same precursor liquid used in Example 7 is diluted to 16.7 g with water, and then added to 0.20 g of 6% $Fe/CaCO_3$ prepared according to Example 6. The mixture of liquid and solid is heated to about 80° C. with stirring until dry. The solid is further dried at 80° C. in a drying oven for 2 hours.

Example 9

6% Iron and 100 ppm Pd on $CaCO_3$ Support 16.67 g of the same precursor solution used for Example 7 is used without further dilution, and is added to 0.20 g of 6% $Fe/CaCO_3$ prepared according to Example 6. The mixture of liquid and solid is heated to about 80° C. with stirring until dry. The solid is further dried at 80° C. in a drying oven for 2 hours.

Examples 10 Through 18

The catalysts of Examples 1 through 9 were tested for CO oxidation activity in Examples 10 through 18, respectively. All Examples 10 through 18 were conducted identically. In each case, 100 mg of finished catalyst was mixed with quartz wool and then packed into a quartz flow tube. The flow tube was placed in a tubular furnace, and a flow of gas containing 2.94% by vol of carbon monoxide, 21% by volume oxygen, and the balance nitrogen at a total flow rate of 1000 sccm. A thermocouple was placed within the catalyst zone to continuously monitor the reaction temperature. The reactor temperature was then ramped at a rate of 12° C. per minute. The exiting gas was periodically sampled and tested by gas chromatography to determine the amount of carbon monoxide remaining at a series of temperatures spanning the temperature range of the experiment. The carbon monoxide fractional conversion at each temperature was calculated as the molar amount of carbon monoxide consumed divided by the molar amount of carbon monoxide in the feed gas. This was then converted to a percent conversion by multiplying by 100.

The results of Examples 10 through 18 are summarized in the following table:

| Example 10 | | Example 11 | | Example 12 | | Example 13 | | Example 14 | |
|---|---|---|---|---|---|---|---|---|---|
| Temp. (° C.) | Conv. (%) | Temp. (° C.) | Conv. (%) | Temp. (° C.) | Conv. (%) | Temp. (° C.) | Conv. (%) | Temp. (° C.) | Conv. (%) |
| 317 | 5 | 363 | 0 | 368 | 2 | 318 | 3 | 323 | 0 |
| 345 | 18 | 388 | 1 | 394 | 6 | 349 | 20 | 348 | 6 |
| 374 | 32 | 414 | 9 | 430 | 41 | 387 | 49 | 376 | 21 |
| 402 | 46 | 460 | 84 | 473 | 86 | 421 | 71 | 405 | 51 |
| 428 | 57 | 482 | 100 | 495 | 90 | 448 | 81 | 436 | 65 |
| 453 | 66 | | | | | 472 | 86 | 462 | 75 |
| 474 | 73 | | | | | 493 | 89 | 487 | 82 |
| 498 | 79 | | | | | | | 513 | 100 |

-continued

| Example 15 | | Example 16 | | Example 17 | | Example 18 | |
|---|---|---|---|---|---|---|---|
| Temp. (° C.) | Conv. (%) | Temp. (° C.) | Conv. (%) | Temp. (° C.) | Conv. (%) | Temp. (° C.) | Conv. (%) |
| 288 | 16 | 278 | 10 | 279 | 10 | 272 | 7 |
| 317 | 24 | 304 | 17 | 312 | 32 | 339 | 90 |
| 345 | 32 | 333 | 26 | 359 | 64 | 384 | 95 |
| 371 | 39 | 359 | 33 | 389 | 74 | | |
| 397 | 45 | 387 | 41 | 415 | 77 | | |
| 422 | 49 | 413 | 46 | 438 | 78 | | |
| 448 | 55 | 436 | 50 | 463 | 78 | | |
| 471 | 59 | 483 | 60 | 484 | 79 | | |
| 496 | 63 | 508 | 65 | | | | |

Figure 3:
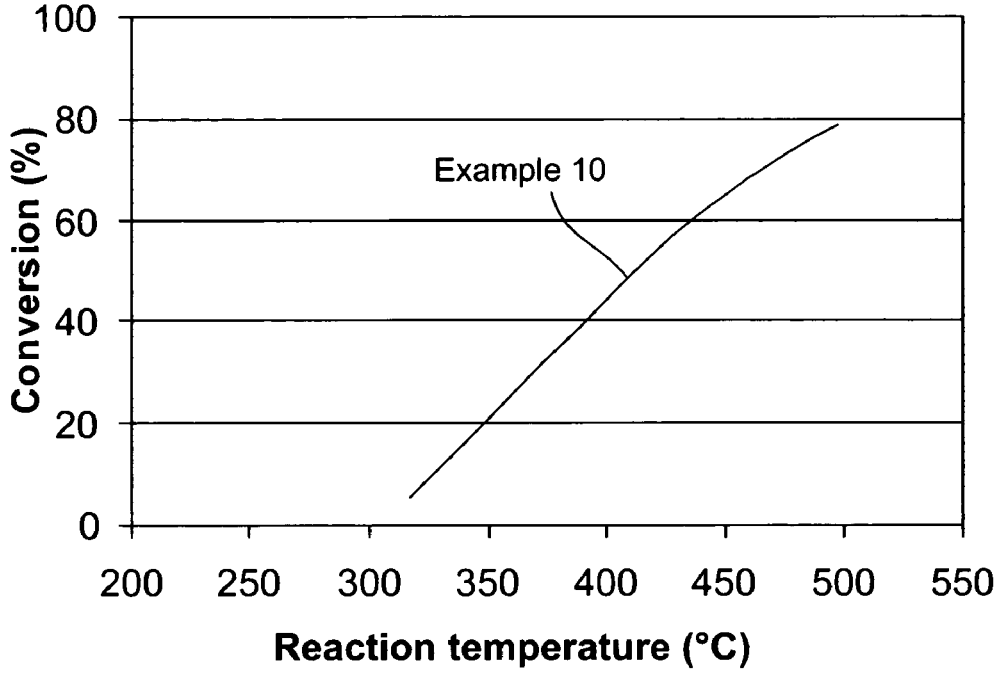
FIG. 3 is a graph showing carbon monoxide conversion using the catalyst of Example 10.
Figure 4:
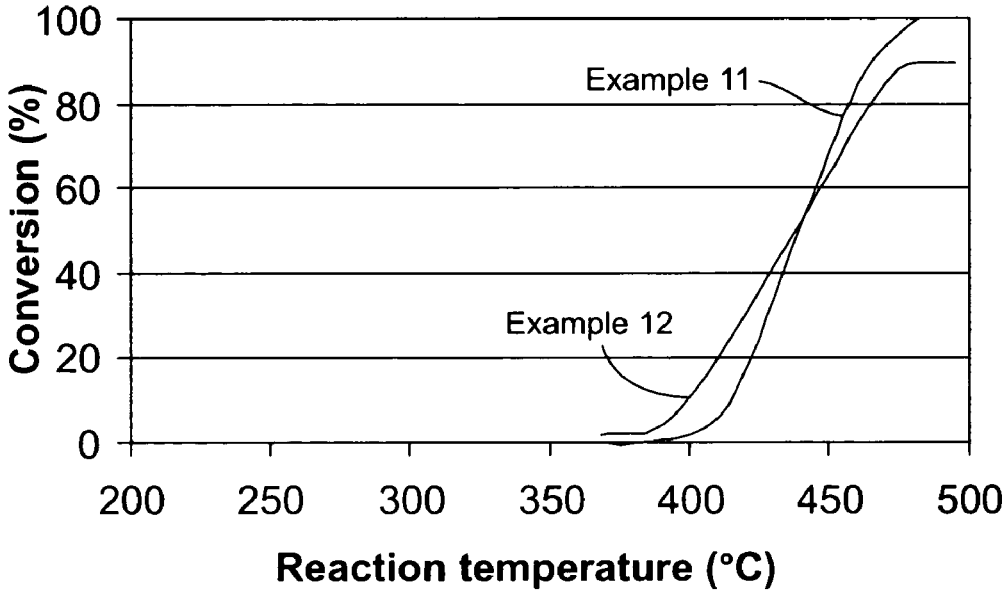
FIG. 4 is a graph showing carbon monoxide conversion using the catalysts of Examples 11 and 12.
Figure 5:
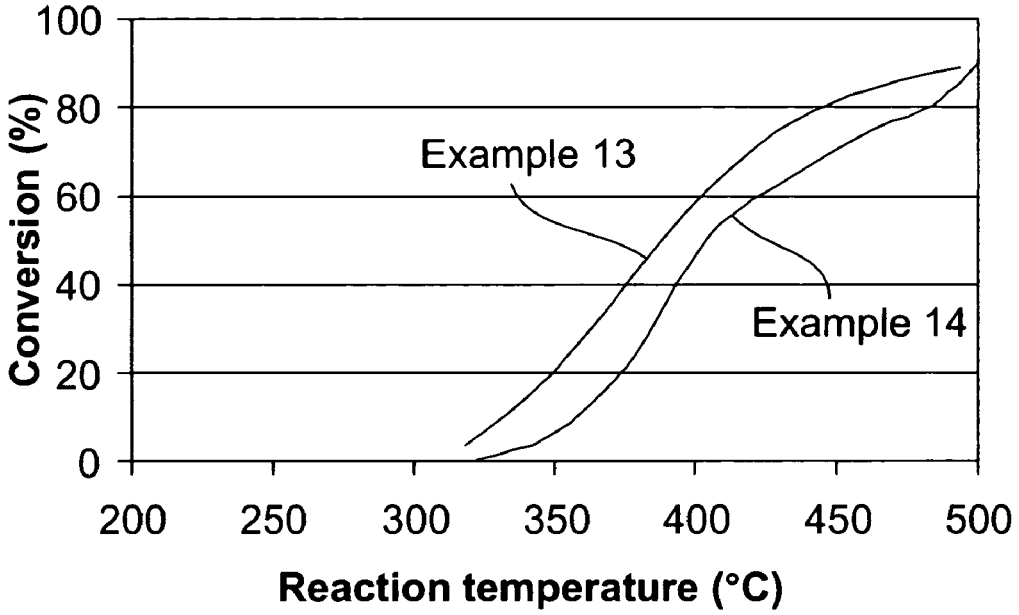
FIG. 5 is a graph showing carbon monoxide conversion using the catalysts of Examples 13 and 14.
Figure 6:
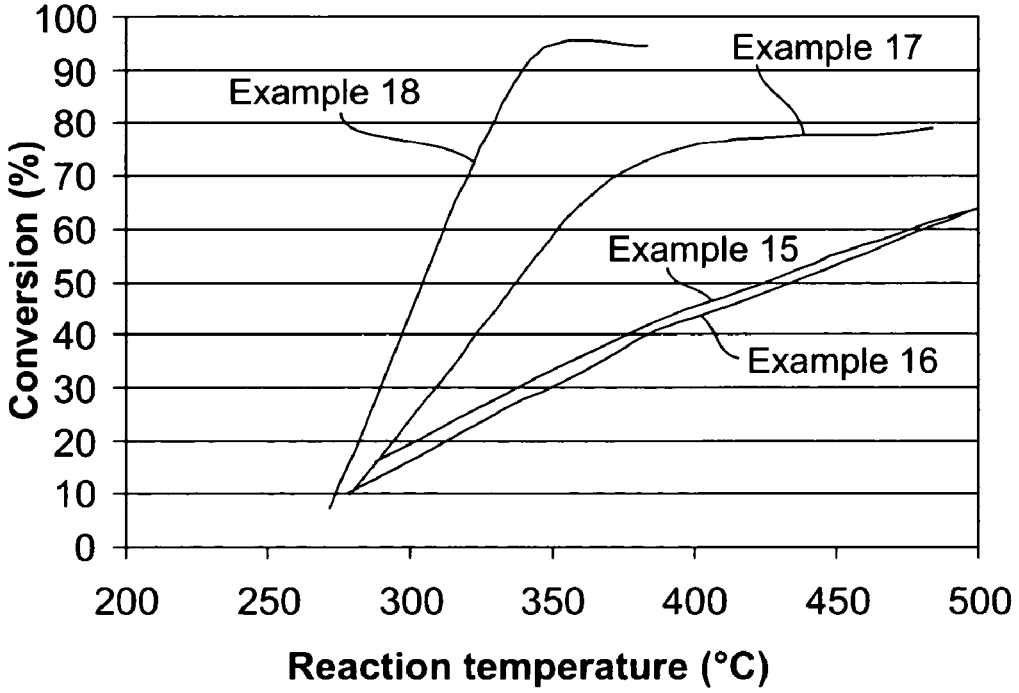
FIG. 6 is a graph showing carbon monoxide conversion using the catalysts of Examples 15, 16, 17, and 18.

FIGS. 3-6 are graphs that illustrate the results of examples 10-18. FIGS. 3-6 show the conversion of carbon monoxide to carbon dioxide at various temperatures. FIG. 3 shows conversion for an iron catalyst on an alumina support. FIG. 4 illustrates the difference in conversion of carbon monoxide as the support is changed from alumina (Example 11) to calcium carbonate (Example 12). FIG. 5 illustrates the difference between using an $Al_2O_3$ support (Example 13) and a $CaCO_3$ support (Example 14) with an iron platinum catalyst. FIG. 6 compares an iron catalyst (Example 15) with an iron palladium catalyst with palladium increasing in concentration from 1 ppm (Example 16) to 10 ppm (Example 17, and 100 ppm (Example 18).

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A tobacco composition for generating tobacco smoke with reduced amounts of undesirable small molecules, including a reduced amount of nitric oxide compared to combustion of untreated tobacco material, the tobacco composition comprising:

a tobacco material; and a catalyst composition on a support material, the catalyst composition comprising:

a plurality of active atoms dispersed to form nanoparticles having a size less than about 100 nm and being capable of reducing the concentration of at least one type of undesirable small molecule in tobacco smoke; and a dispersing agent comprising at least one functional group selected from the group consisting of a hydroxyl, a carboxyl, a thiol, a sulfonic acid, a sulfonyl halide, a carbonyl, an amine, an amide, an amino acid, an acyl halide and combinations thereof, wherein the dispersing agent is bound to the nanoparticles, anchors the nanoparticles to the support material, and inhibits agglomeration of the nanoparticles prior to use of the tobacco composition, the tobacco composition being configured so as to generate a reduced amount of nitric oxide upon combustion compared to combustion of untreated tobacco material.

2. A tobacco composition as in claim 1, wherein the nanoparticles are adapted so as to catalyze the conversion of CO to $CO_2$ during combustion of the tobacco material.

3. A tobacco composition as in claim 1, wherein the active atoms are selected from the group consisting of manganese, manganese oxides, iron, iron oxide, platinum, palladium, vanadium oxide, aluminum oxide, silica, titania, yttria, and combinations thereof.

4. A tobacco composition as in claim 1, wherein the active atoms consist essentially of iron and/or iron oxide, and a noble metal.

5. A tobacco composition as in claim 1, wherein the support material comprises the tobacco material.

6. A tobacco composition as in claim 1, wherein the support material comprises a plurality of particles selected from the group consisting of carbon black, graphite, silica, alumina, calcium carbonate, zeolites, metal oxides, and polymers.

7. A tobacco composition as in claim 1, further comprising a filter adjacent to the tobacco material, wherein the nanoparticles are disposed on or within the cigarette filter.

8. A tobacco composition as in claim 1, further comprising a cigarette paper wrapped around the tobacco material, wherein the nanoparticles are disposed on or in the cigarette paper.

9. A tobacco composition as in claim 1, wherein the dispersing agent is selected from the group consisting of small organic acids and polymers.

10. A tobacco composition as in claim 1, wherein the dispersing agent is selected from the group consisting of glycolic acid, oxalic acid, malic acid, citric acid, pectins, amino acids, celluloses, and combinations thereof.

11. A tobacco composition as in claim 1, wherein the nanoparticles have a size less than about 20 nm.

12. A tobacco composition as in claim 1, wherein the nanoparticles have a size less than about 5 nm.

13. A tobacco composition for generating tobacco smoke with reduced undesirable small molecules, including a reduced amount of nitric oxide compared to combustion of untreated tobacco material, comprising:

a tobacco material; and a catalyst composition mixed with the tobacco material to form a tobacco-catalyst blend, the catalyst composition comprising, a plurality of nanoparticles comprising iron and having a size less than about 100 nm, the nanoparticles comprising a noble metal and one or both of iron or iron oxide and being capable of reducing the concentration of CO in a tobacco smoke; and a dispersing agent bound to the nanoparticles so as to stabilize the nanoparticles during combustion or pyrolysis of the tobacco material, the dispersing agent comprising at least one functional group selected from the group consisting of a hydroxyl, a carboxyl, a thiol, a sulfonic acid, a sulfonyl halide, a carbonyl, an amine, an amide, an amino acid, an acyl halide and combinations thereof, the tobacco composition configured so as to generate a reduced amount of nitric oxide upon combustion compared to combustion of untreated tobacco material.

14. A tobacco composition as in claim 13, wherein the tobacco-catalyst blend has an iron loading less than about 5% by weight.

15. A method of making a tobacco composition according to claim 13, comprising:

(a) providing a tobacco material that produces hot gasses when combusted or pyrolyzed;

(b) preparing a plurality of catalyst nanoparticles by reacting together:

(i) a plurality of catalyst atoms comprising a noble metal and one or both of iron or iron oxide; and (ii) a dispersing agent comprising at least one functional group selected from the group consisting of a hydroxyl, a carboxyl, a thiol, a sulfonic acid, a sulfonyl halide, a carbonyl, an amine, an amide, an amino acid, an acyl halide and combinations thereof, wherein the dispersing agent is bound to the nanoparticles; and (c) mixing the catalyst nanoparticles with the tobacco material such that upon combustion or pyrolysis of the tobacco material, hot gasses generated from the tobacco material come into contact with the catalyst nanoparticles and catalyze the degradation of at least one type of undesirable small molecule and wherein the dispersing agent stabilizes the nanoparticles during combustion or pyrolysis of the tobacco material.

16. A method as in claim 15, wherein the catalyst atoms comprise iron and the noble metal.

17. A method as in claim 15, wherein the catalyst nanoparticles are chemically bonded to the tobacco material.

18. A method as in claim 15, wherein (b) further comprises reacting the catalyst atoms and dispersing agent in a liquid.

19. A method of reducing the concentration of carbon monoxide or other undesirable small molecules in tobacco smoke, comprising:

providing a tobacco composition as defined in claim 1 material; and combusting or pyrolyzing the tobacco material, the catalyst nanoparticles reducing the percentage of carbon monoxide or nitric oxide in the gasses generated by the combustion or pyrolysis of the tobacco material, the dispersing agent stabilizing the nanoparticles during combustion or pyrolysis of the tobacco material.

20. A method as in claim 19, wherein the active atoms are selected from the group consisting of manganese, manganese oxides, iron, iron oxide, platinum, palladium, vanadium oxide, aluminum oxide, silica, titania, yttria, and combinations thereof.

21. A method as in claim 19, wherein the catalyst is associated with the tobacco by directly mixing the catalyst with the tobacco material.

22. A method as in claim 19, wherein the catalyst composition is associated with the tobacco material by placing the catalyst composition in or on a filter positioned adjacent to the tobacco material within a cigarette.

23. A method as in claim 19, wherein the catalyst composition is associated with the tobacco material by placing the catalyst composition on or in a cigarette paper that is wrapped around the tobacco material.

24. A tobacco composition as in claim 1, wherein the catalyst composition is in a range of about 0.2% to about 15% by weight of the tobacco material.

25. A tobacco composition as in claim 13, wherein the catalyst composition is in a range of about 0.2% to about 15% by weight of the tobacco material.

26. A tobacco composition for generating tobacco smoke with reduced amounts of undesirable small molecules, including a reduced amount of nitric oxide compared to combustion of untreated tobacco material, the tobacco composition comprising:

a tobacco material; and a catalyst composition on a support material, the catalyst composition comprising:

a plurality of active atoms dispersed to form nanoparticles having a size less than about 100 nm and being capable of reducing the concentration of at least one type of undesirable small molecule in tobacco smoke; and a dispersing agent comprising at least one functional group selected from the group consisting of a hydroxyl, a carboxyl, and a carbonyl, and combinations thereof, wherein the dispersing agent is bound to the nanoparticles, anchors the nanoparticles to the support material, and inhibits agglomeration of the nanoparticles prior to use of the tobacco composition, the tobacco composition configured so as to generate a reduced amount of nitric oxide upon combustion compared to combustion of untreated tobacco material.

* * * * *

UNITED STATES PATENT AND TRADEMARK OFFICE

CERTIFICATE OF CORRECTION

PATENT NO. : 7,856,992 B2
APPLICATION NO. : 11/054196
DATED : December 28, 2010
INVENTOR(S) : Zhou et al.

It is certified that error appears in the above-identified patent and that said Letters Patent is hereby corrected as shown below:

Face, Page 1, Right Hand Column

Item 56, References Cited, U.S. PATENT DOCUMENTS, change the reference "4,273,749 A 6/1981 Kimura etal" to --4,273,749 A 6/1981 Kimura et al.--

Item 56, References Cited, OTHER PUBLICATIONS, change the reference "Sun, et al., Monodisperse MFe2O4 (M = Fe, Co, Mn) Nanoparticles, J. Am. Chem. Soc. 2004, 126, 273-279.*" to --Sun, et al., Monodisperse $MFe_2O_4$ (M = Fe, Co, Mn) Nanoparticles, J. Am. Chem. Soc. 2004, 126, 273-279.*--

Page 2, Right Hand Column, Item 56, References Cited, OTHER PUBLICATIONS

Change the reference "Asami, Kenji et al., "Highly Active Iron Catalysts from Ferrie Chloride for the Steam Gasification of Brown Coal", American Chemical Society, Ind. Eng. Chem. Res. 1993, 32 pgs. 1631-1636." to --Asami, Kenji et al., "Highly Active Iron Catalysts from Ferric Chloride for the Steam Gasification of Brown Coal", American Chemical Society, Ind. Eng. Chem. Res. 1993, 32 pgs. 1631-1636.--

Change the reference "Ohtsuka, Yasuo et al., "Char-Nitrogen Functionality and Interactions between the Nitrogen and Iron in the Iron-Catalyzed Conversion Process of Coal Nitrogen to N2" Research Center for Organic Resources and Materials Chemistry, Institute for Chemical Reactions Science, Tohoku University, Sendai, Japan, pp. 1356-1362, (May 6, 1998)." to --Ohtsuka, Yasuo et al., "Char-Nitrogen Functionality and Interactions between the Nitrogen and Iron in the Iron-Catalyzed Conversion Process of Coal Nitrogen to $N_2$" Research Center for Organic Resources and Materials Chemistry, Institute for Chemical Reactions Science, Tohoku University, Sendai, Japan, pp. 1356-1362, (May 6, 1998).--

Change the reference "Ohtsuka, Yasuo et al., "Selective Conversion of Coal Nitrogen to N2 with iron", Research Center for Cabonaceous Resources, Institute for Chemical Reactions Science, Tohoku, Japan, pp. 1095-1096 (Aug. 3, 1993)." to --Ohtsuka, Yasuo et al., "Selective Conversion of Coal Nitrogen to $N_2$ with iron", Research Center for Carbonaceous Resources, Institute for Chemical Reactions Science, Tohoku; Japan, pp. 1095-1096 (Aug. 3, 1993).--

Signed and Sealed this
Third Day of May, 2011

David J. Kappos

David J. Kappos
*Director of the United States Patent and Trademark Office*

Page 2, Right Hand Column, Item 56, References Cited, OTHER PUBLICATIONS, cont.

Change the reference "Tsubouchi, Naoto et al., "Nitrogen Release During High Temperature Pyrolysis of Coals and Catalytic Role of Calcium in N2 Formation", Research Center for Sustainable Material Engineering, Institute of Multidisciplinary Research for Advanced Material, Tohoku, Japan, pp,. 2335-2342 (Ma4. 20, 2002)." to --Tsubouchi, Naoto et al., "Nitrogen Release During High Temperature Pyrolysis of Coals and Catalytic Role of Calcium in $N_2$ Formation", Research Center for Sustainable Material Engineering, Institute of Multidisciplinary Research for Advanced Material, Tohoku, Japan, pp. 2335-2342 (Ma4. 20, 2002).--

Page 3, Left Hand Column, Item 56, References Cited, OTHER PUBLICATIONS

Change the reference "Wang, H.P. et al., "Spectroscopic Studies of Coal Maceral Depolymerization Effected by an Iron-Based Catalystl", U.S. Department of Energy 1992, http://www-acerc.byu.edu/Abstracts/19. (1992)." to --Wang, H.P. et al., "Spectroscopic Studies of Coal Maceral Depolymerization Effected by an Iron-Based Catalyst", U.S. Department of Energy 1992, http://www-acerc.byu.edu/Abstracts/19. (1992).--

Change the reference "Wu, Zhiheng et al., "Key Factors for Formation of N2 from Low-Rank Coals during Fixed Pyrolysis: Pryolysis Conditions and Inherent Minerals", Institute for Chemical Reaction Science, Tohoku University, Sendai, Japan, pp. 902-908 (Feb. 4, 1997)." to --Wu, Zhiheng et al., "Key Factors for Formation of $N_2$ from Low-Rank Coals during Fixed Pyrolysis: Pyrolysis Conditions and Inherent Minerals", Institute for Chemical Reaction Science, Tohoku University, Sendai, Japan, pp. 902-908 (Feb. 4, 1997).--

Change the reference "Wu, Zhiheng et al., "Nitrogen Distribution in a Fixed Bed Pyrolysis of Coals with Different Ranks: Formation and Source of N2", Insti-" to --Wu, Zhiheng et al., "Nitrogen Distribution in a Fixed Bed Pyrolysis of Coals with Different Ranks: Formation and Source of $N_2$", Insti- --

Column 1

Lines 58-59, change "catalyst" to --catalysts--

Column 2

Line 22, change "catalysts" to --catalyst--
Line 42, change "10 nm even" to --10 nm, even--
Line 50, change "nanoparticles" to --nanoparticle--

Column 3

Line 15, change "catalysts" to --catalyst--

Column 5

Line 15, change the second instance of "an" to --a--

Column 6

Line 30, change "0.5" to --0.5:1--

Column 8
Line 8, change both instances of "m2/g" to --$m^2$/g--
Line 46, change "an" to --a--
Line 60, change "nitrate" to -- nitrates--

Column 12
Line 8, change "the cut a" to --the cut of a--
Line 28, change "m2/g" to --$m^2$/g--

Column 13
Line 36, change "PdCl2" to --$PdCl_2$--
Line 38, change "H2PtCl6" to --$H_2PtCl_6$--
Line 47, change "Fe/CaCO3" to --$Fe/CaCO_3$--